US010060229B2

(12) United States Patent
Malbrel et al.

(10) Patent No.: US 10,060,229 B2
(45) Date of Patent: Aug. 28, 2018

(54) SWELLING SLEEVE METHOD TO PREVENT GRAVEL PACK MOVEMENT INTO VOIDS ADJACENT SCREEN CONNECTIONS AND EXPOSING SCREEN PORTIONS

(71) Applicant: BAKER HUGHES INCORPORATED, Houston, TX (US)

(72) Inventors: Christophe A. Malbrel, Houston, TX (US); Nervy E. Faria, Houston, TX (US); Steve Rosenblatt, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 434 days.

(21) Appl. No.: 14/675,312

(22) Filed: Mar. 31, 2015

(65) Prior Publication Data

US 2016/0290109 A1 Oct. 6, 2016

(51) Int. Cl.
*E21B 43/04* (2006.01)
*E21B 33/12* (2006.01)

(52) U.S. Cl.
CPC ..... *E21B 43/04* (2013.01); *E21B 33/1208* (2013.01)

(58) Field of Classification Search
CPC ... E21B 33/1208; E21B 43/04; E21B 33/1277
See application file for complete search history.

(56) References Cited

U.S. PATENT DOCUMENTS

| | | | | |
|---|---|---|---|---|
| 6,520,254 | B2 | 2/2003 | Hurst et al. | |
| 6,719,051 | B2 * | 4/2004 | Hailey, Jr. | E21B 34/06 166/236 |
| 7,320,367 | B2 | 1/2008 | Brezinski et al. | |
| 7,866,405 | B2 | 1/2011 | Richards et al. | |
| 7,934,555 | B2 | 5/2011 | Morton | |
| 2004/0108112 | A1 | 6/2004 | Nguyen et al. | |
| 2007/0240877 | A1 | 10/2007 | O'Malley et al. | |
| 2008/0135260 | A1 * | 6/2008 | Berzin | E21B 33/1208 166/380 |
| 2008/0142227 | A1 | 6/2008 | Yeh et al. | |
| 2010/0139917 | A1 | 6/2010 | Weirich | |
| 2011/0056706 | A1 * | 3/2011 | Brooks | E21B 17/105 166/387 |
| 2011/0132599 | A1 * | 6/2011 | Xu | E03B 3/15 166/228 |
| 2013/0062049 | A1 * | 3/2013 | Ren | B29C 44/5636 166/101 |

* cited by examiner

*Primary Examiner* — Caroline N Butcher
(74) *Attorney, Agent, or Firm* — Steve Rosenblatt

(57) ABSTRACT

A gravel pack of screen sections separated by blank pipe is accomplished with sleeves around the blank sections that have a smaller run in dimension to allow the gravel to get past the sleeves during the gravel packing. When the gravel packing is complete the sleeves swell or otherwise enlarge to fill the voids where no or insufficient amount of gravel has been deposited. The presence of the enlarged sleeves prevents settling or shifting of the gravel pack away from the screens because voids that would otherwise have been there are filled with the enlarged sleeves. This is more of an issue in wells that are closer to vertical than horizontal.

19 Claims, 6 Drawing Sheets

SWELLING SLEEVE METHOD TO PREVENT GRAVEL PACK MOVEMENT INTO VOIDS ADJACENT SCREEN CONNECTIONS AND EXPOSING SCREEN PORTIONS

FIELD OF THE INVENTION

The field of the invention is gravel packing of screens at subterranean locations where gravel pack movement is a risk that can expose screen portions to high velocity fluid flow which can be erosive of the screen.

BACKGROUND OF THE INVENTION

Completions frequently combine sections of screens that are connected directly or with short sections of blank pipe. The process of gravel packing is well known in the industry and comprises of depositing "gravel" typically a specialized sand in the annular space surrounding the screen assembly. The gravel is pumped through surface tubing into a tool known as a crossover and into the annular space that surrounds the screens. The gravel stays in the annular space but the carrier fluid goes through the screens and into an internal annulus between the screen and another pipe known as a wash pipe and back up into the wash pipe and out of the borehole through the crossover to an upper annulus above the production packer. One of the purposes of the gravel pack is to protect the screens from the erosive effects of high velocity gases by presenting a line of defense that diffuses the flow to protect the screen. The gravel also retains some of the solids carried with the production before those solids hit the screen to prolong screen useful life or to increase throughput during the life of the screen.

The nature of stacks of screens is that that the stack has dead zones where there are no screen openings. The delivered gravel tends to keep moving past these dead zones as the carrier fluid keeps moving until it finds screen openings to flow through and into the wash pipe. In horizontal completions this does not present a major issue as the gravel stays put due to the force of gravity so unpacked zones opposite connecting pipe does not risk exposing of screen in the event of a gravel pack shift. In wells that are closer to vertical than horizontal this can be a situation that allows some of the gravel pack to shift or settle by gravity away from the initial placement location to the annular space about the blank pipe separating the screen sections. This settling or shifting can leave portions of the screen assembly exposed to undesirable high velocity fluid, normally gas that can erode holes in the screens rendering such screens inoperative for their intended purpose.

For high deviation wells (close to horizontal), gravel packing may be used using low density proppant that have the propensity to float and be easily dragged by fluid flow. Gravel movement away from the screen could lead to screen exposure, formation sand production through the bare screen and potential screen erosion.

In the past efforts to avoid gravel pack voids have tried putting screened openings in the blank pipe connecting screen sections in an effort to encourage deposition of gravel outside the blank portions, mainly to enhance distribution of flow toward the screen sections.

A references discussing gravel packs and issues encountered in them is U.S. Pat. No. 7,934,555. External sleeves that swell to form isolators for expanded pipe in a borehole are discussed in general in U.S. Pat. No. 7,320,367.

The present invention addresses the gravel voids in boreholes by providing sleeves in those areas that have their smallest dimension when running in and when gravel is deposited and then swell in the presence of well fluids to take up the voids in the gravel pack around the connectors. In this way collapse of the existing gravel pack or low density proppant movement away from the screens is prevented while an effective gravel pack around the screens is assured. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A gravel pack of screen sections separated by blank pipe is accomplished with sleeves around the blank sections that have a smaller run in dimension to allow the gravel to get past the sleeves during the gravel packing. When the gravel packing is complete the sleeves swell or otherwise enlarge to fill the voids where no or insufficient amount of gravel has been deposited. The presence of the enlarged sleeves prevents settling or shifting of the gravel pack away from the screens because voids that would otherwise have been there are filled with the enlarged sleeves.

DETAILED DESCRIPTION OF THE PREFERRED EMBODIMENT

Figure 1:
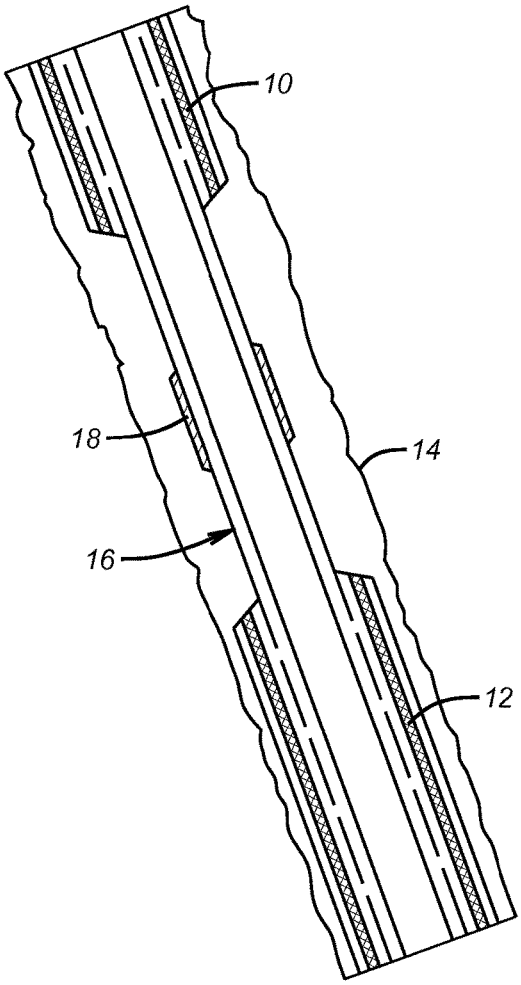
(PRIOR ART) FIG. 1
FIG. 1 is a run in view of a prior art system before the gravel packing starts.
Figure 2:
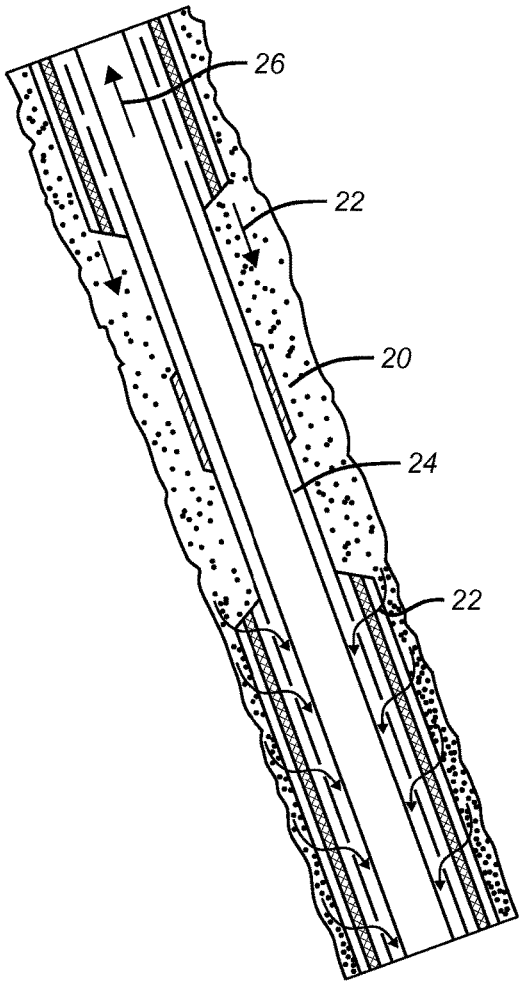
(PRIOR ART) FIG. 2
FIG. 2 is the view of FIG. 1 during gravel packing.
Figure 3:
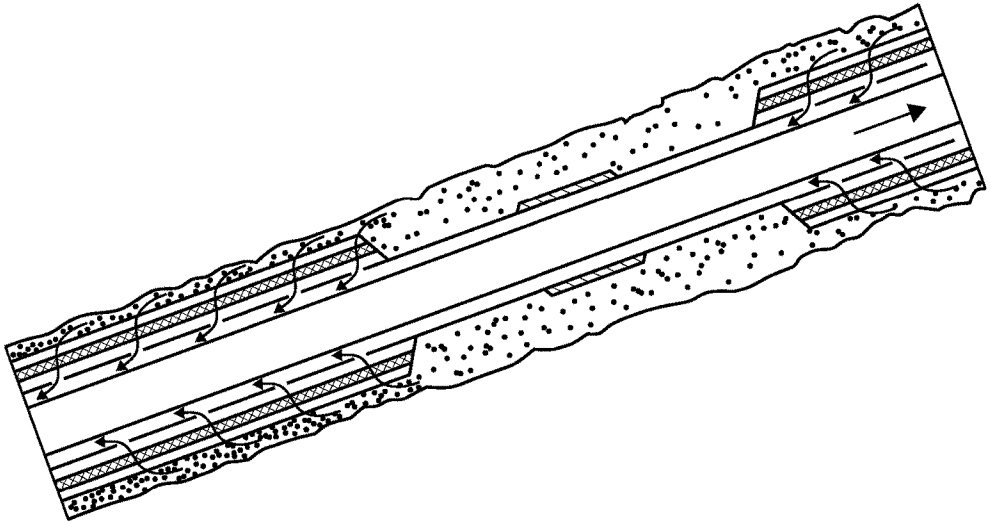
(PRIOR ART) FIG. 3
FIG. 3 is the view of FIG. 2 illustrating how the slurried gravel at the blank pipe connections does not dehydrate.
Figure 4:
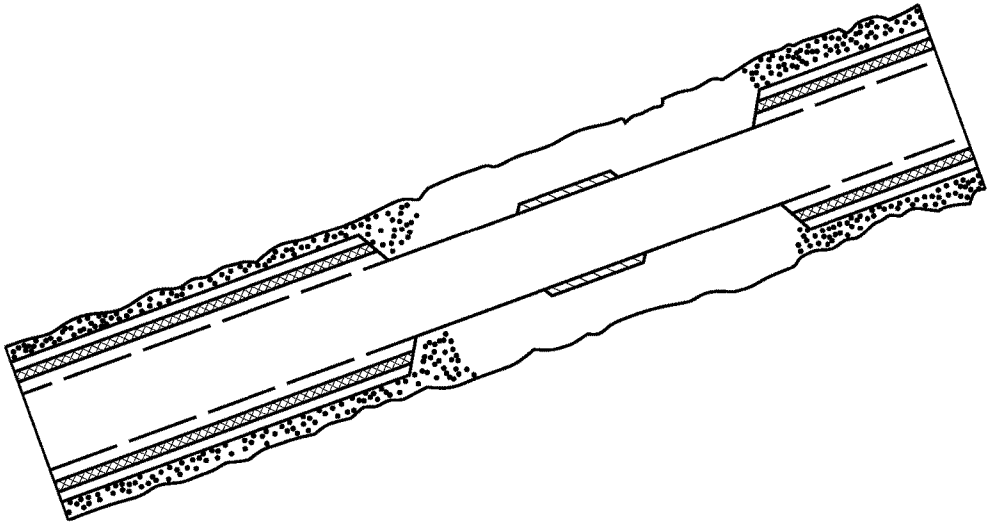
(PRIOR ART) FIG. 4
FIG. 4 is the view of FIG. 3 showing a void after time as the gravel at the blank settles out.
Figure 5:
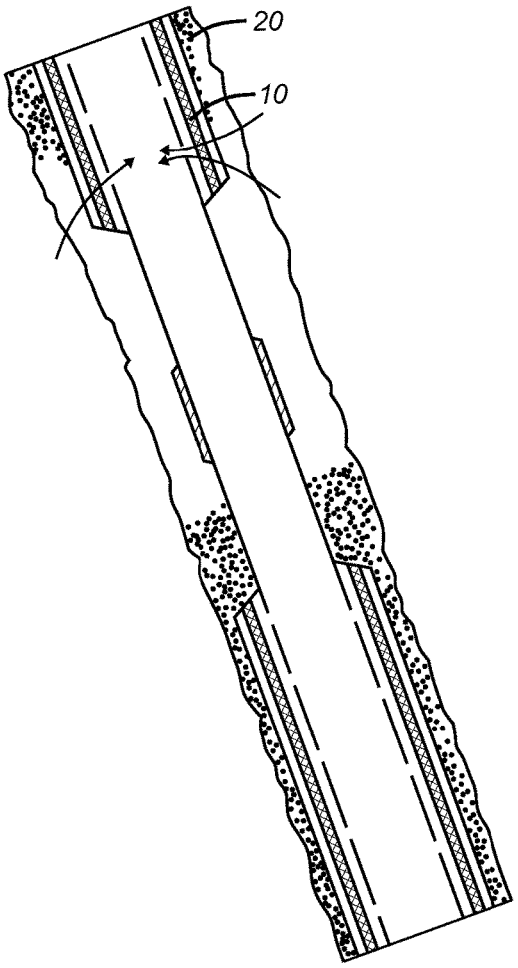
(PRIOR ART) FIG. 5
FIG. 5 is the view of FIG. 4 after production starts where gravel settlement leaves a portion of the screens uncovered.

FIG. 1 shows a prior art portion of a screen assembly showing screens 10 and 12 in a borehole 14 that is an open hole. Between the screens 10 and 12 is a blank section of pipe 16 a part of which can be the coupling 18 between screen joints. In FIG. 2 the gravel 20 is being deposited and it collects more densely at the screens 10 and 12 than at the blank pipe section 16 for the simple reason that there are no return paths for the gravel carrier fluid represented by arrows 22 to return through the screens 10 and 12 and into the wash pipe 24 and back through a crossover that is not shown and to the surface in an upper annulus above a production packer that are both also not shown. FIG. 3 illustrates the conclusion of the gravel packing where there is a very dilute concentration of gravel 20 in the blank pipe section 16. As shown in FIG. 4, the zone 16 ultimately has no gravel 20 in section 16 due to settlement by gravity of the gravel 20 in that zone. Eventually, as shown in FIG. 5 some of the gravel falls away from the lower end of the upper screen 10 leaving it bare and exposed to erosion from high velocity fluids.

Figure 6:
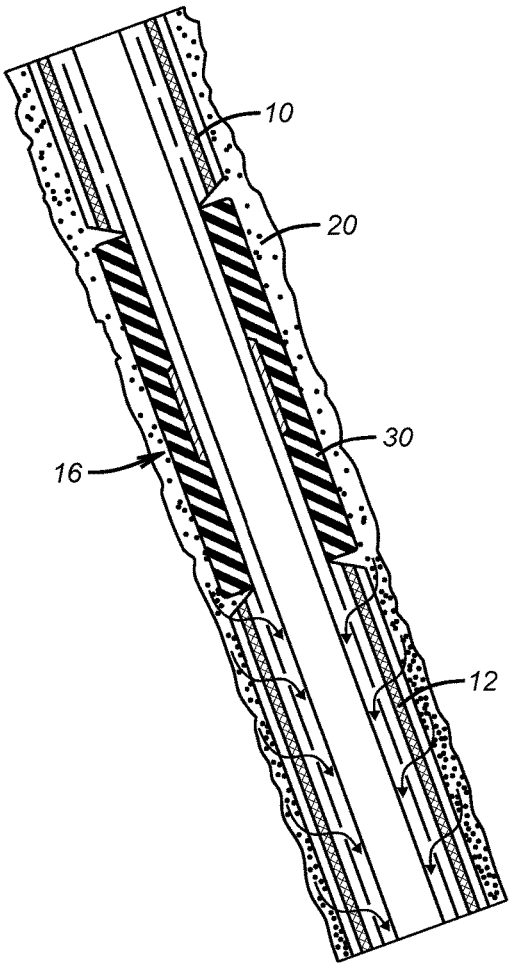
FIG. 6 shows a sleeve around the blank section of pipe in its run in dimension.
Figure 7:
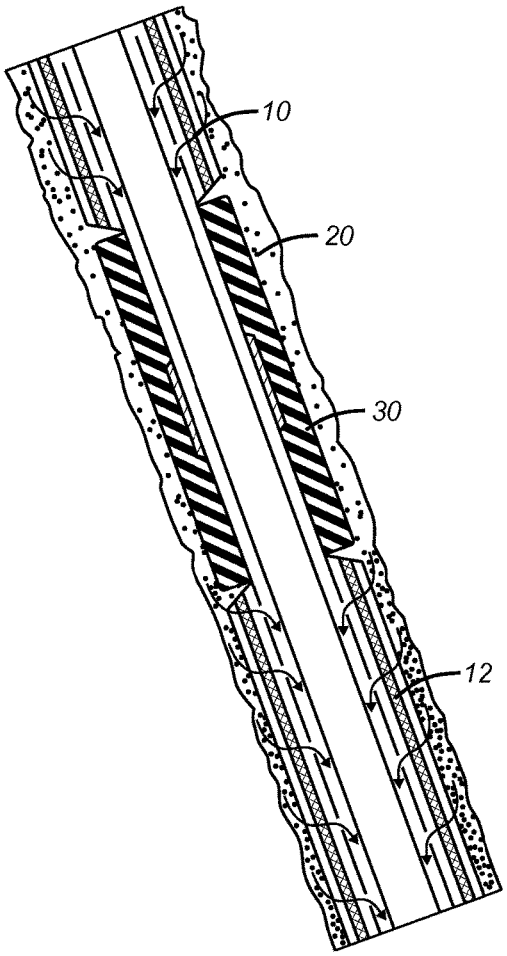
FIG. 7 is the view of FIG. 6 as the sleeve grows in dimension.
Figure 8:
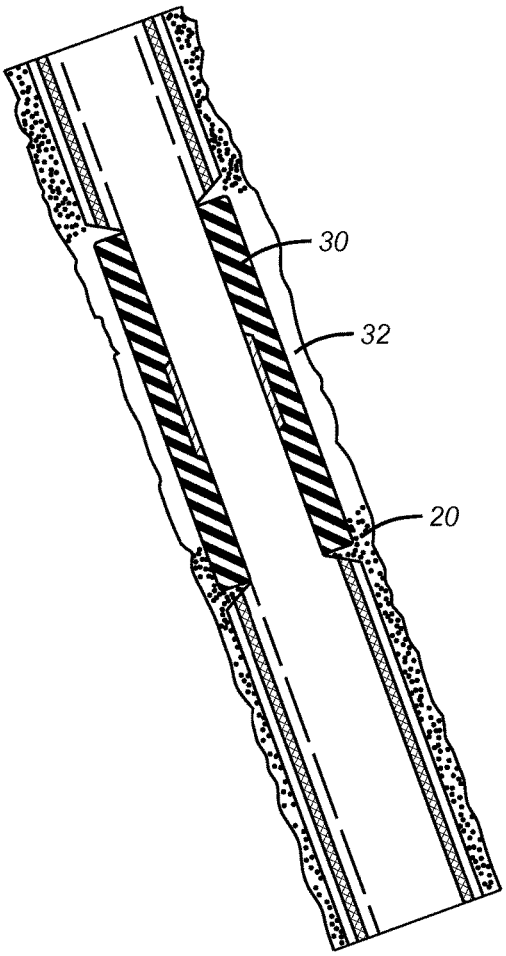
FIG. 8 is the view of FIG. 7 showing the limited space for gravel settlement in view of the enlarged sleeve diameter.
Figure 9:
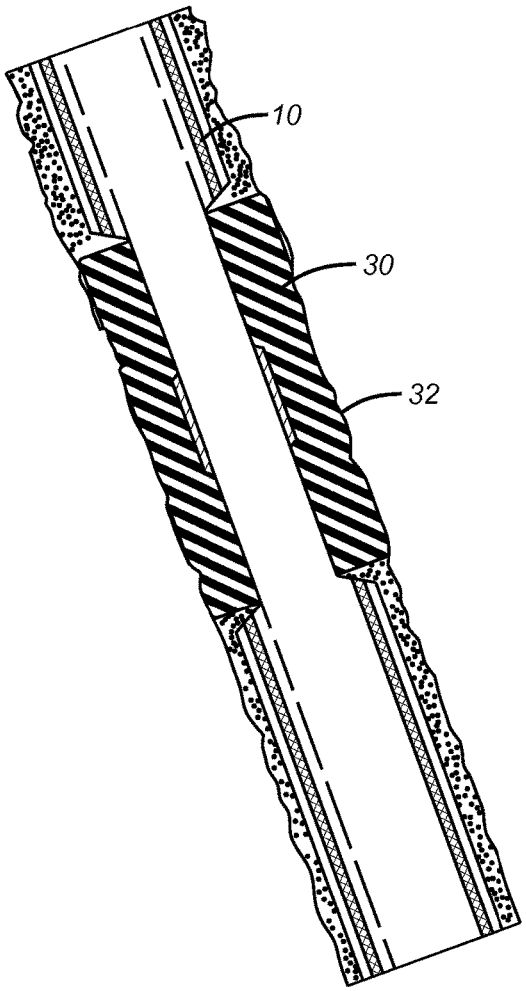
FIG. 9 is the view of FIG. 8 showing the sleeve filling the annular space around the blank pipe section.

As shown in FIG. 6 the present invention addresses this issue which is more serious the more vertical the borehole. As shown in FIG. 6 a sleeve 30 extends for the length of the section 16 and has a first dimension that is small enough to allow gravel 20 to get past. Screen 12 has a fully packed annular space in FIG. 6 while the accumulation at screen 10 is continuing. In FIG. 7 the gravel is packing near screen 10 as the gravel packing continues. FIG. 8 shows that gravel 20 has settled out of section 16 as the sleeve 30 continues to grow in dimension in the annulus 32. In FIG. 9 the sleeve has spanned the annulus 32 and supports the gravel 20 opposite screen 10.

Figure 11:
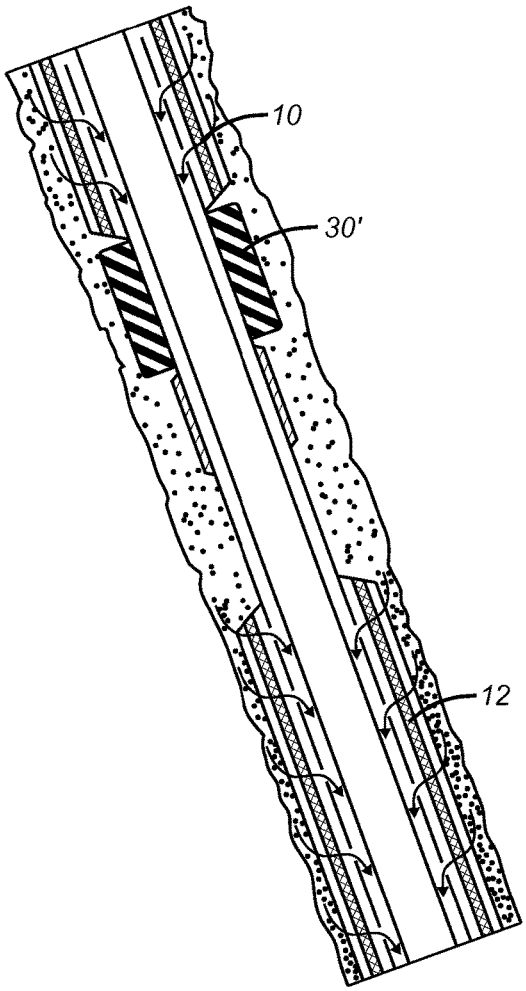
FIG. 11 illustrating a sleeve that is shorter than the length of blank pipe that can still accomplish the desired effect of holding the gravel against the screen sections.
Figure 10A:
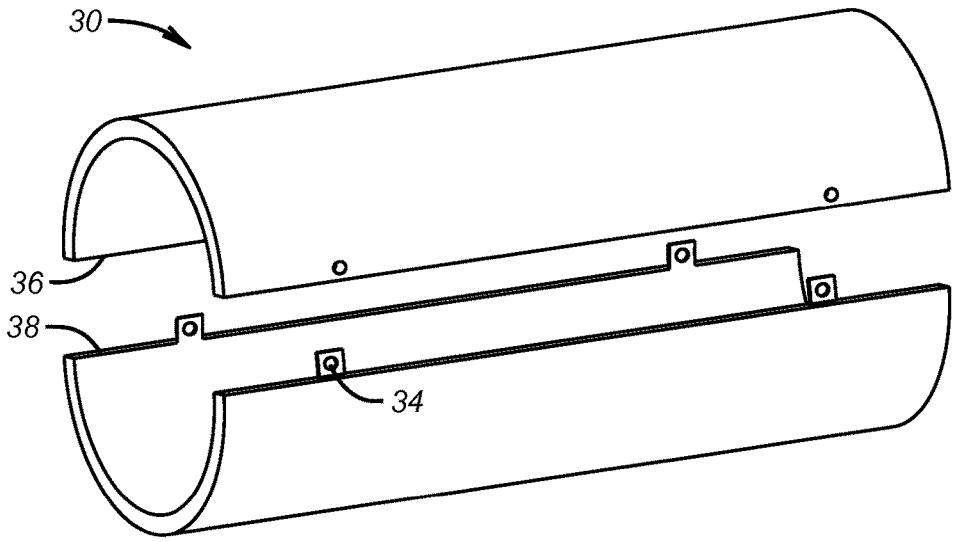
FIGS. 10*a* and 10*b* show a longitudinally split sleeve that can be put on the blank pipe section either as two half shells or hinged on one side respectively.
Figure 10B:
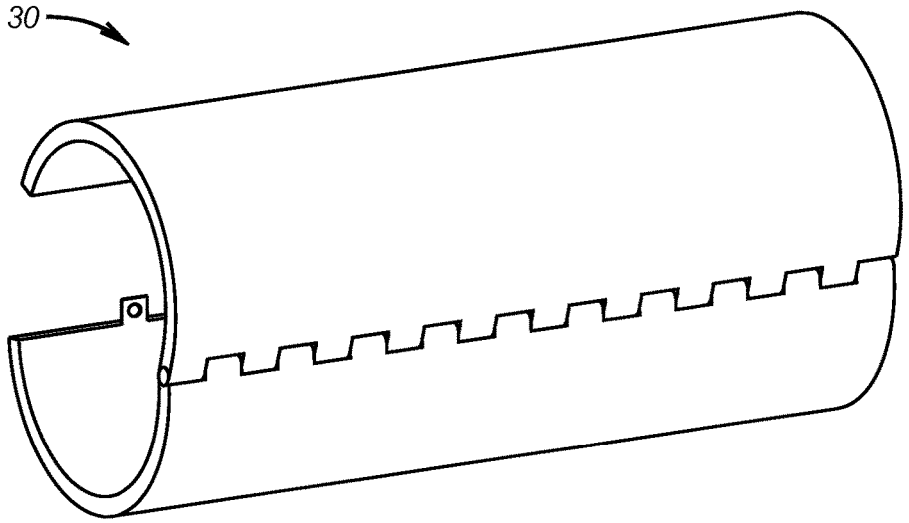

FIGS. 10*a* and 10*b* show the sleeve 30 as longitudinally split with a hinge 34 and longitudinal ends 36 and 38 that can be attached to each other with a fastener or adhesive or zip ties or some other band clamp to hold the closed position over the blank pipe in section 16. FIG. 11 illustrates a sleeve 30' that can be shorter than the section 16 as long as it is placed just under a screen 10 to support the gravel 20 that is around it and keep that gravel from settling away from the screen 10.

Those skilled in the art will appreciate that while one sleeve 30 is shown between screens 10 and 12 that additional sleeves are contemplated adjacent each blank section 16 below a given screen. The sleeves can swell or can be ingredients that mix to create a material that fills the annular space or other means of eventual enlargement after the gravel packing is accomplished such as a shape memory polymer or alloy that reverts to a larger size when crossing its critical temperature on exposure to well fluids or applied heating or an inflatable member to mention a few possible variations. Another possibility is a material that not only grows in dimension for reasons of support of the gravel but that also has some porosity to allow production flow axially between screen sections. The various materials or reactants are known in the art and the common feature is sufficient structural integrity while spanning the annular space to keep the gravel positioned adjacent the screen sections while preventing gravel collapse that would otherwise leave the screen sections exposed. The sleeves permit the gravel to be distributed and then enlarge to a gravel pack at an adjacent screen to allow the gravel to remain in place against the force of gravity in wells that are not completely horizontal. The sleeve can be the length of section 16 or shorter. It can be one piece or multiple pieces which grow at the same or at different rates. It can be a split sleeve or a seamless sleeve put over the blank section 16 on assembly of the screen sections. In a swelling embodiment such as an elastomer rubber the sleeve can have an external coating which is removed in the borehole environment by heat or chemical action as a delay mechanism for the growth in diameter such as by swelling to allow time to complete the gravel pack before the dimension increases in section 16. The porous embodiment can be an open cell foam.

The above description is illustrative of the preferred embodiment and many modifications may be made by those skilled in the art without departing from the invention whose scope is to be determined from the literal and equivalent scope of the claims below:

We claim:

1. A completion method, comprising:

running in a plurality of screen sections separated by blank pipe sections into a borehole said screen sections each having a downhole end, said screen sections defining an open annular space between said screen sections and a surrounding borehole wall or conduit;

providing a gravel pack retaining member in a first configuration on said blank pipe sections adjacent said downhole ends of said screen sections when running in such that said open annular space is only obstructed by said gravel pack retaining member in said first configuration;

gravel packing said screen sections through said open annular space impeded only by said gravel pack retaining member;

enlarging said retaining member to a second configuration to retain gravel adjacent a respective screen section.

2. The method of claim 1, comprising:

making said retaining member swell to reach said second configuration.

3. The method of claim 1, comprising:

making said retaining member of a shape memory material that reverts to a larger dimension with exposure to borehole fluids to reach said second configuration.

4. The method of claim 1, comprising:

making said retaining member of reactants that react with each other to occupy an annular space in said second configuration.

5. The method of claim 1, comprising:

occupying the entire length of said blank pipe section between said screen sections with said retaining member.

6. The method of claim 1, comprising:

occupying less than the entire length of said blank pipe section between said screen sections with said retaining member.

7. The method of claim 1, comprising:

making said retaining member a split sleeve.

8. The method of claim 1, comprising:

making said retaining member a seamless sleeve.

9. The method of claim 1, comprising:

allowing gravel to pass said retaining member in said first configuration.

10. The method of claim 1, comprising:

making said retaining member porous.

11. A completion assembly, comprising:

a plurality of screen sections each comprising downhole ends and separated by at least one adjacent blank section;

a gravel retention device on said blank section and adjacent said downhole ends and movable from a run in position where gravel slurry can flow past the retention device for initial gravel packing to a second position to support deposited gravel at a said screen section against gravity settlement;

said gravel retention device on said blank section in said run in position representing the only impediment to gravel flow in an annular space between said screens and said blank section and a surrounding borehole wall or tubular during deposition of the gravel.

12. The assembly of claim 11, comprising:

said retention device swells toward said second position.

13. The assembly of claim 11, comprising:

said retention device comprises a shape memory material that reverts to a larger dimension upon crossing a critical temperature.

14. The assembly of claim 11, comprising:

said retention device is porous.

15. The assembly of claim 11, comprising:

said retention device comprises reactive components and moves to said second position as a result of a reaction between said reactive components of said retention device.

16. The assembly of claim 11, comprising:

said retention device comprises a split or seamless sleeve.

17. The assembly of claim 11, comprising:

said retention device extends the entire length of said blank section.

18. The assembly of claim 17, comprising:

said retention device extends for less than the entire length of said blank section and is positioned immediately adjacent a respective screen section to counteract gravitational force that would otherwise move gravel away from said respective screen section in the time after said retention device is fully actuated.

19. A completion method using the assembly of claim 11.

* * * * *